United States Patent [19]

Racek

[11] 4,340,356

[45] Jul. 20, 1982

[54] GAS LIGHTER

[76] Inventor: Alfred Racek, Seitenbergstr. 54, 1160, Wien, Austria

[21] Appl. No.: 126,360

[22] Filed: Mar. 3, 1980

[51] Int. Cl.[3] ..... F23G 1/04; F23G 7/12

[52] U.S. Cl. ..... 431/254; 431/125; 431/275

[58] Field of Search ..... 431/254, 131, 255, 274, 431/275, 276, 277, 125

[56] References Cited

U.S. PATENT DOCUMENTS

| | | | |
|---|---|---|---|
| 2,912,841 | 11/1959 | Racek et al. | 431/125 X |
| 3,504,995 | 4/1970 | Kanamaru | 431/254 |
| 3,520,647 | 7/1970 | Van Poppel | 431/254 |
| 3,617,160 | 11/1971 | Racek | 431/125 |

*Primary Examiner*—Edward G. Favors
*Attorney, Agent, or Firm*—Karl F. Ross

[57] ABSTRACT

A gas lighter has a pistol-shaped casing that contains a gas cartridge in line with a mouthpiece which simulates a muzzle and forms a hood overhanging a striker wheel coacting with a spring-pressed flint. The striker wheel is clamped between cheeks of a reel which is eccentrically linked with a slider having an actuator in the shape of a trigger and trigger guard, the latter being articulated to a toggle joint urged by a transverse spring into a nearly straight-line position whereby a squeezing of the trigger results in an accelerating rotation of the wheel against the flint. The slider also opens a shut-off valve at the cartridge to allow the outflow of gas which is ignited by sparks from the flint hurled toward the hood.

4 Claims, 5 Drawing Figures

GAS LIGHTER

FIELD OF THE INVENTION

My present invention relates to a cigarette lighter or the like of the type wherein a pyrophoric device is used to ignite a flow of flammable gas emitted by a suitable source, usually a cartridge, inside a casing having a mouthpiece aperture in line with that source.

BACKGROUND OF THE INVENTION

Pryophoric devices used in such a lighter generally comprise an abrasive striker wheel coacting with a flint which is pressed against the striker-wheel surface by a spring. Rapid rotation of the wheel generates sparks igniting a flow of gas emitted by the source upon the simultaneous opening of a normally closed shut-off valve. Such rapid rotation can usually be brought about when the striker wheel is acted upon by a stored force, e.g. that of a spring which is stressed by the closure of a lid and released when the lid is allowed to snap open. With direct manual actuation, however, special means must be provided to convert the user's finger pressure into the acceleration required. Such means conventionally may take the form of humps coacting with the wheel drive to provide a resistance necessitating the buildup of a certain force which imparts the desired rotation to the striker wheel upon overcoming that resistance. This type of mechanism, however, is generaly somewhat cumbersome and does not always operate satisfactorily.

OBJECTS OF THE INVENTION

The basic object of my present invention, therefore, is to provide simple actuating means for the rapid acceleration of an abrasive striker wheel forming part of a pyrophoric spark generator for the purpose described.

A more particular object is to provide actuating means of this type in a pistol-shaped lighter where ignition is to be brought about by finger motion simulating the pulling of a trigger.

SUMMARY OF THE INVENTION

In accordance with my present invention I provide a spring-loaded toggle joint linked in the lighter casing with the aforementioned manual actuating means for urging same into an unoperated position and opposing manual displacement thereof with a progressively decreasing force, thereby enabling rapid acceleration of the striker wheel coupled with the actuating means.

Pursuant to a more specific feature of my invention, a slider constituting the actuating means is linked with a rotatable wheel holder at a location offset from the axis of rotation thereof and is articulated to a longer lever of the toggle joint at a first fulcrum, this longer lever being hingedly connected to a shorter lever which is articulated to the casing at a second fulcrum substantially in the line of motion of the first fulcrum. The toggle joint further includes a spring bearing upon one of these levers, preferably the longer one, in a sense tending to maintain the levers in a nearly aligned position.

BRIEF DESCRIPTION OF THE DRAWING

The above and other features of my present invention will now be described in detail with reference to the accompanying drawing in which.

SPECIFIC DESCRIPTION

Figure 1:
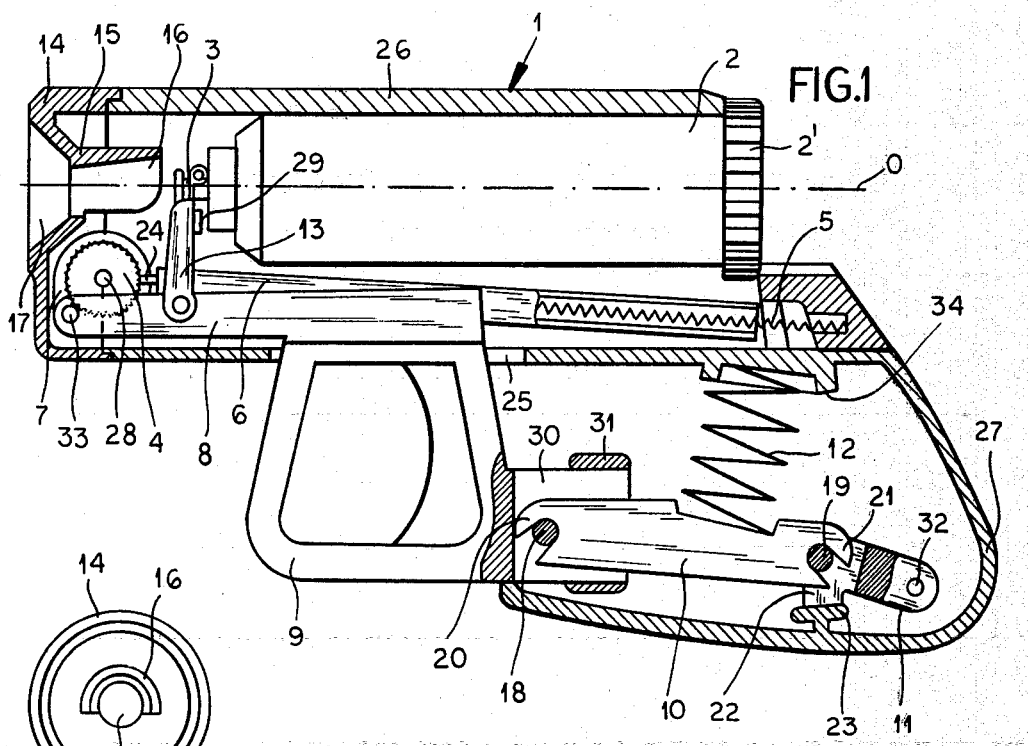
FIG. 1 is a longitudinal sectional view of my improved gas lighter in a quiescent position.
Figure 3:
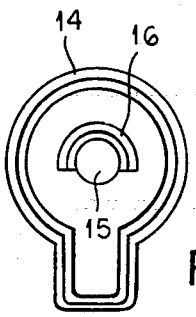
FIG. 3 is a face view of a mouthpiece forming part of the lighter.

The lighter shown in the drawing comprises a casing 1 with a barrel-shaped upper part 26 and a flat lower part 27 simulating a pistol grip. The barrel 26 is closed at the front by a tightly fitting but preferably detachable mouthpiece 14 and at the back by the bottom 2' of an inserted gas cartridge 2. Mouthpiece 14, simulating a muzzle, has an aperture 15 which is centered on the axis 0 of cartridge 2 and is aligned with a shut-off valve 3 normally blocking an outlet at the front end of the cartridge. An intervening ignition space is bounded at the top by a hood 16 rigid with the mouthpiece, this hood having a generally semicylindrical outer surface and a tapering inner surface narrowing toward aperture 15. Mouthpiece 14 further forms an external shroud 17 of frustoconical shape broadening outwardly, i.e. in the direction of a gas flow issuing from cartridge 2 and passing through aperture 15 when the valve 3 is opened.

On the side of axis 0 opposite hood 16, i.e. below the ignition space separating the cartridge outlet from aperture 15, there is provided a pyrophoric device comprising an abrasive striker wheel 4 against which a flint 24 guided in a stationary tube 6 is pressed by a coil spring 5. Striker wheel 4, lying in a plane which includes the cartridge axis 0, is clamped between cheeks of a reel 7 which has a hub traversing the reel and is rotatably mounted on a pin 28. Reel 7 is eccentrically joined by a pin 33 to a slider 8 rigid with an actuator 9 which passes through a slot 25 on the underside of barrel 26 and is shaped like a trigger and trigger guard of a pistol. A lever 13 pivoted to slider 8 engages the valve 3 of cartridge 2 and carries a tab 29 which comes to rest against the rim of the front end of the cartridge when the actuator 9 is moved to the right as shown in FIG. 2, thereby swinging counterclockwise to open the valve 3. A bifurcate extension 30 of actuator 9, guided between fixed lugs 31 in pistol grip 27, may be considered part of the slider and carries a pin 18 which is received in a slot of an extremity 20 of a lever 10 embraced by the bifurcation 30; the opposite extremity 21 of lever 10 is bracketed by prongs of a bifurcate extremity of a shorter lever 11 and has a slot receiving a pivot pin 19 on the latter lever. The end of lever 11 remote from pin 19 has a fixed fulcrum in the form of a pin 32 secured to casing 1, this pin being almost in line with the path of motion of pin 18 upon the displacement of slider 8 between the positions shown in FIGS. 1 and 2. It will be understood that actuator 9 is guided with sufficient play to let the pin 33 swing through an arc between the two limiting positions shown in these Figures.

Figure 2:
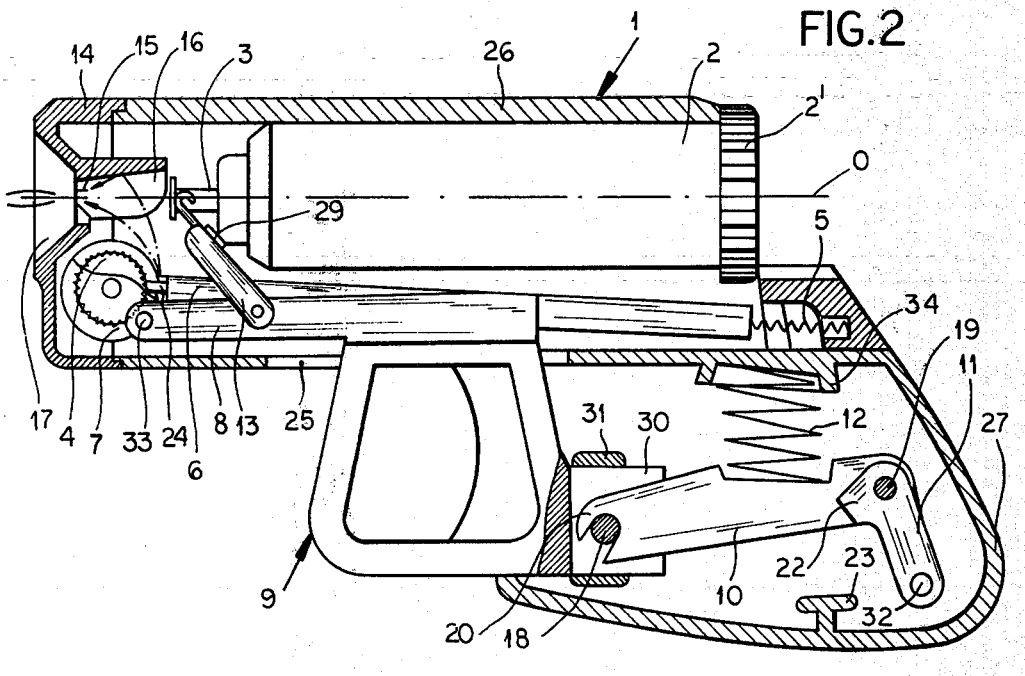
FIG. 2 is a view similar to FIG. 1 but showing the lighter in an operated position.

A coil spring 12, received in a lodgement 34 of casing 1, bears under moderate pressure upon lever 10 in the vicinity of pivot 19 to urge the toggle joint constituted by levers 10 and 11 into a nearly straight-line position, as shown in FIG. 1, in which an extension 22 of lever 11 comes to rest on an internal abutment 23 within pistol grip 27. A user inserting a finger into the trigger guard of actuator 9 must therefore exert considerable initial pressure to dislodge the toggle joint from the position of FIG. 1, yet the resistance encountered drops off rapidly as the joint approaches the angular position of FIG. 2. The exerted force thus becomes available for a rapid counterclockwise acceleration of striker wheel 4 which generates sparks flying toward the ignition space now traversed by a flow of gas issuing from cartridge 2 through the opened valve 3. Though a considerable number of these sparks may traverse the gas too quickly to be able to ignite same, they are promptly redirected by the overhanging hood 16 toward the axis 0 in order to do their work on being swept out by the gas flow through aperture 15. Shroud 17 protects the exiting sparks from outside drafts, thereby further facilitating ignition, and also shields the resulting flame. Upon the release of actuator 9, spring 12 returns the mechanism to the quiescent position of FIG. 1 with closure of valve 3.

The slotted extremities of lever 10 engaging pins 18 and 19 simplify the assembly of the toggle joint. Since the slots point away from spring 12, the pressure exerted by that spring prevents any disengagement.

Figure 4:
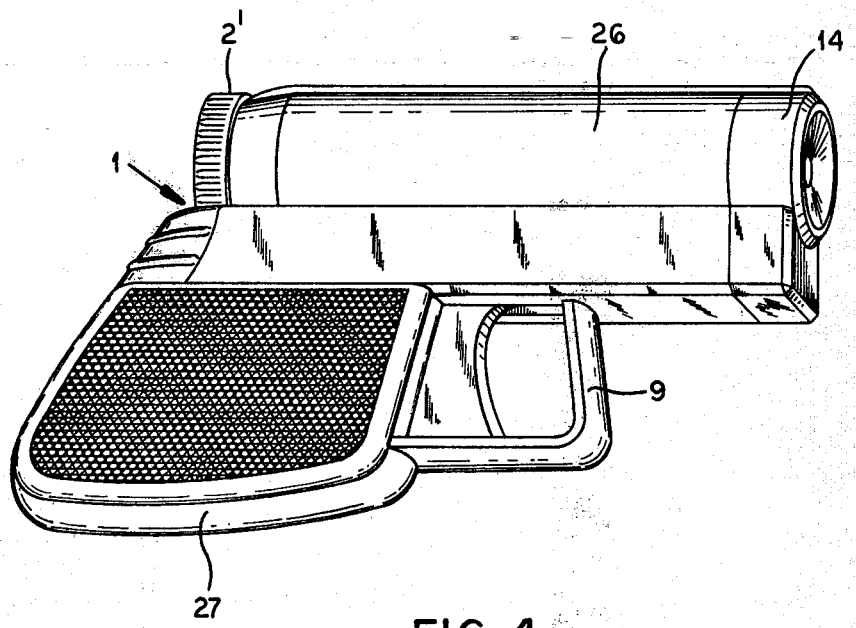
FIG. 4 is a perspective view of the lighter seen partly from the front.
Figure 5:
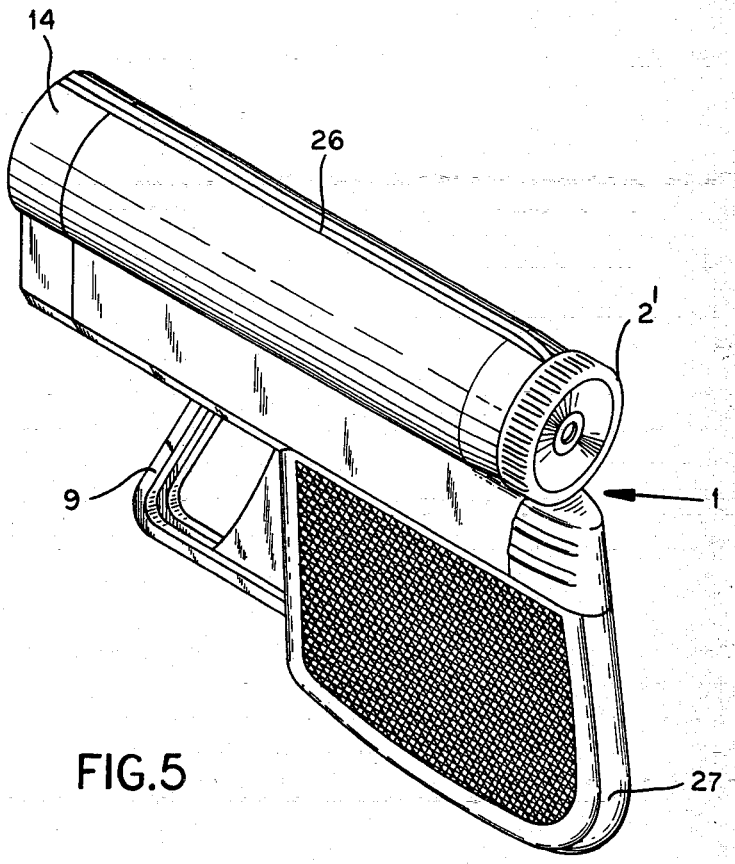
FIG. 5 is a perspective view of the lighter seen partly from the rear.

The pistol-shaped lighter illustrated in FIGS. 4 and 5 is the subject matter of my design application Ser. No. 118,776 filed Feb. 5, 1980.

I claim:

1. A gas lighter comprising:

a casing provided with a mouthpiece having an aperture;

a source of flammable gas in said casing aligned with said aperture and provided with a normally closed shut-off valve;

pyrophoric means in said casing for igniting gas issuing from said source upon the opening of said shut-off valve, said pyrophoric means including a flint holder and a striker wheel coacting with a flint carried by said holder;

manual actuating means coupled with said shut-off valve for setting said striker wheel in rotation and concurrently opening said shut-off valve and for generating a gas flow ignited by sparks from said flint, said actuating means including a rotatable holder for said striker wheel centered on an axis of rotation and a slider linked with said rotatable holder at a location offset from said axis; and a spring-loaded toggle joint in said casing linked with said actuating means for urging same into an unoperated position and opposing manual displacement thereof with a progressively decreasing force enabling rapid acceleration of said striker wheel, said toggle joint including a longer lever articulated to said slider at a first fulcrum and a shorter lever articulated to said casing at a second fulcrum substantially in the line of motion of said first fulcrum, said levers being hingedly interconnected at a pivot point, said toggle joint further including a spring bearing upon one of said levers in a sense tending to maintain a nearly aligned position of said levers.

2. A gas lighter as defined in claim 1 wherein said casing is provided with an abutment engaged by an extension of said shorter lever in said nearly aligned position.

3. A gas lighter as defined in claim 2 wherein said slider is provided with a first pin at said first fulcrum and said shorter lever is provided with a second pin at said pivot point, said first lever having slotted extremities straddling said first and second pins under pressure from said spring.

4. A gas lighter as defind in claim 2 or 3 wherein said casing is generally pistol-shaped and forms a pistol grip around said toggle joint, said source being a gas cartridge disposed in a barrel-shaped part of said casing which adjoins said pistol grip and terminates in a simulated muzzle forming said mouthpiece, said slider forming a simulated trigger and trigger guard projecting from said housing for engagement by a finger of a user grasping said pistol grip.

* * * * *

UNITED STATES PATENT AND TRADEMARK OFFICE

CERTIFICATE OF CORRECTION

PATENT NO. : 4,340,356

DATED : 20 July 1982

INVENTOR(S) : Alfred RACEK

It is certified that error appears in the above-identified patent and that said Letters Patent is hereby corrected as shown below:

On the title page

In the heading, left column, between items [22] and [51], insert the following priorities (item [30], "Foreign Application Priority Data"):

-- 1627/79, dated 5 March 1979, Austria;

515,845, dated 2 March 1979, Austria. --.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*